US008001650B2

(12) United States Patent
Trotter

(10) Patent No.: US 8,001,650 B2
(45) Date of Patent: Aug. 23, 2011

(54) AUTOMATIC DEBRIS COLLECTOR FOR A CENTRAL VACUUM SYSTEM

(76) Inventor: Jerry Trotter, Anderson, SC (US)

( * ) Notice: Subject to any disclaimer, the term of this patent is extended or adjusted under 35 U.S.C. 154(b) by 1308 days.

(21) Appl. No.: 11/586,373

(22) Filed: Oct. 25, 2006

(65) Prior Publication Data

US 2007/0174991 A1 Aug. 2, 2007

Related U.S. Application Data

(60) Provisional application No. 60/764,194, filed on Feb. 1, 2006.

(51) Int. Cl.
*A47L 5/38* (2006.01)

(52) U.S. Cl. ..... 15/315; 15/314; 15/339

(58) Field of Classification Search ..... 15/314, 15/315, 323, 414, 339; 285/7, 302, 303, 285/338, 196, 216

See application file for complete search history.

(56) References Cited

U.S. PATENT DOCUMENTS

| | | | | |
|---|---|---|---|---|
| 3,676,986 | A * | 7/1972 | Reiling | 55/472 |
| 4,050,113 | A * | 9/1977 | Wright et al. | 15/315 |
| 5,526,842 | A | 6/1996 | Christensen | |
| 6,143,996 | A | 11/2000 | Skanda | |
| 6,182,327 | B1 * | 2/2001 | Gosselin | 15/315 |
| 6,481,047 | B1 * | 11/2002 | Schaefer | 15/314 |
| 7,010,829 | B2 * | 3/2006 | Harman et al. | 15/315 |
| 2005/0022329 | A1 | 2/2005 | Harman et al. | |
| 2005/0246855 | A1 | 11/2005 | Stockton et al. | |

OTHER PUBLICATIONS

Print out of website—www.hideahose.biz, Hide-A-Hose, Inc., The Retractable Hose Central Vac System, Dec. 14, 2005.

* cited by examiner

*Primary Examiner* — Dung Van Nguyen
(74) *Attorney, Agent, or Firm* — Dority & Manning, P.A.

(57) ABSTRACT

An accessory to a central vacuum system provides a handy, resiliently retractable vacuum hose that is accessible and usable by the operator with only one hand and easily and unobtrusively stored by the operator when not in use.

18 Claims, 5 Drawing Sheets

AUTOMATIC DEBRIS COLLECTOR FOR A CENTRAL VACUUM SYSTEM

CROSS-REFERENCE TO RELATED APPLICATIONS

The present application claims priority to currently U.S. Provisional Patent Application No. 60/764,194 filed Feb. 1, 2006.

STATEMENT REGARDING FEDERALLY SPONSORED RESEARCH OR DEVELOPMENT

N/A

BACKGROUND OF THE INVENTION

In a conventional central vacuum system installed in a building for example, each room of the building is provided with a wall fixture. One end of a flexible hose has a mating fixture that can be inserted into the wall fixture, and a vacuum will be provided at the free end of the hose once the motor of the vacuum system is activated. The user then can vacuum in that room. Unfortunately, the detachable hose is seldom located handily in the room in which the user desires to use the vacuum. This nonavailability of the hose poses a major inconvenience for what is intended to be a system that provides greater convenience than using a conventional vacuum cleaner. Moreover, even if a separate hose were stored in every room, the storage of that hose presents its own inconveniences, especially if storage space is not available in proximity to the vacuum outlet for the system in that room. Additionally, the aforementioned inconveniences become magnified when they persist in rooms where frequent vacuumings are required because the activities that take place in such rooms repeatedly generate waste that requires vacuuming.

A retractable hose central vacuum cleaning system apparatus and method is disclosed in U.S. Patent Application Publication No. U.S. 2005/0022329 A1. In this system 10, a retractable vacuum hose 12 is stored within a vacuum pipe 18 when not in use and is constrained in the deployed configuration by a clamp 80 that is opened or closed by operation of a clamp lever 82, which when closed will lock the vacuum hose 12 in a position that prevents further deployment or retraction of the hose. The clamp 80 is housed within a valve housing 22 that can be installed within a standard wall construction between wall surfaces through an opening in the wall. The typical full length of the hose is about 35 feet, and accordingly the full deployment of 35 feet of hose can pose a tripping hazard.

Moreover, storage of this length of hose requires a commensurate length of pipe inside the wall in which to store the hose when not in use. Because of the heights of walls and lengths of floors in the typical residence, the storage pipe typically must make at least one 90 degree bend in order to provide the full 35 foot length of storage needed to accommodate the length of hose that needs to be stored.

The vacuum must be operating in order to assist in the retraction of the hose into the storage pipe. The clamp must be manipulated both to hold the hose in the deployed configuration as well as to permit the deployed hose to be retracted. Because the clamp must provide sufficient constricting force to withstand the suction of the vacuum when the hose deployed from the storage pipe, and because the space within the valve housing 22 is limited, substantial operator force must be applied to operate the clamp from the open to closed position and vice versa. Accordingly, the operator requires both hands to withdraw the hose and set the clamp once the desired length of hose has been withdrawn. Moreover, if the clamp should become loosened inadvertently, and the end of the deployed hose jerked away from the operator's hand, the vacuum sucking the hose 12 back into the storage pipe 18 can cause the hose to whip around in a manner that could cause damage to objects and beings in the surroundings.

DETAILED DESCRIPTION OF THE PREFERRED EMBODIMENTS

It is a principal object of the present invention to provide an accessory to a central vacuum system wherein the accessory provides a handy vacuum hose that is accessible and usable by the operator with only one hand and easily and unobtrusively stored by the operator when not in use.

Additional objects and advantages of the invention will be set forth in part in the description that follows, and in part will be obvious from the description, or may be learned by practice of the invention. The objects and advantages of the invention may be realized and attained by means of the instrumentalities and combinations particularly pointed out in the appended claims.

The present invention is useful as an accessory to a central vacuum system that is installed in a building. A compartment can form a housing that is disposed behind the wall of a room of the building and has an access opening into the room. A cover can be configured to selectively provide and deny access through the access opening into the compartment and to seal the cover to the housing when the cover is disposed in the closed position. A switch can be disposed so that when the cover is manipulated to permit access through the access opening into the compartment, the vacuum motor is activated.

A secondary opening can be disposed through one wall of the compartment. A hollow storage conduit can have one end that connects to the secondary opening in the wall of the compartment. The storage conduit is desirably rigidly constructed such as being composed of PVC pipe. The opposite end of the storage conduit can be configured to be connected to a source of vacuum provided by the central vacuum system installed in the building.

A length of flexible, expandable hose equal to the length of the rigid conduit can be installed so that it telescopes into and out of the conduit and through the secondary opening that can be defined through the bottom wall of the compartment or through one of the other walls of the compartment. The distal end of the hose can be fitted with a fixture that ensures vacuum to the proximal end of the hose. The exterior cylindrical edges of the distal end of the fixture desirably are camfered to facilitate easily sliding against the interior of the walls of the storage conduit. The proximal end of the hose can be fitted with a fixed nozzle that is housed within the compartment when the hose is completely retracted into the storage conduit. The nozzle can be configured to be contained within the compartment when the cover is closed to deny access to the compartment through the access opening.

In one exemplary embodiment, the compartment desirably is installed in the vicinity of a hot air dryer in a laundry room for use in vacuuming the lint that accumulates in the lint trap of the dryer. In such an exemplary embodiment, the compartment desirably is disposed so that the secondary opening is located a vertical distance about four feet from the floor level in the room, and the storage conduit extends vertically within the wall of the room.

BRIEF DESCRIPTION OF THE DRAWINGS

The accompanying drawings, which are incorporated in and constitute a part of this specification, illustrate at least one presently preferred embodiment of the invention. These drawings, together with the description, serve to explain the principles of the invention but by no means are intended to be exhaustive of all of the possible manifestations of the invention.

Reference now will be made in detail to the presently preferred embodiments of the invention, one or more examples of which are illustrated in the accompanying drawings. Each example is provided by way of explanation of the invention, which is not restricted to the specifics of the examples. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents. The same numerals are assigned to the same components throughout the drawings and description.

Figure 1:
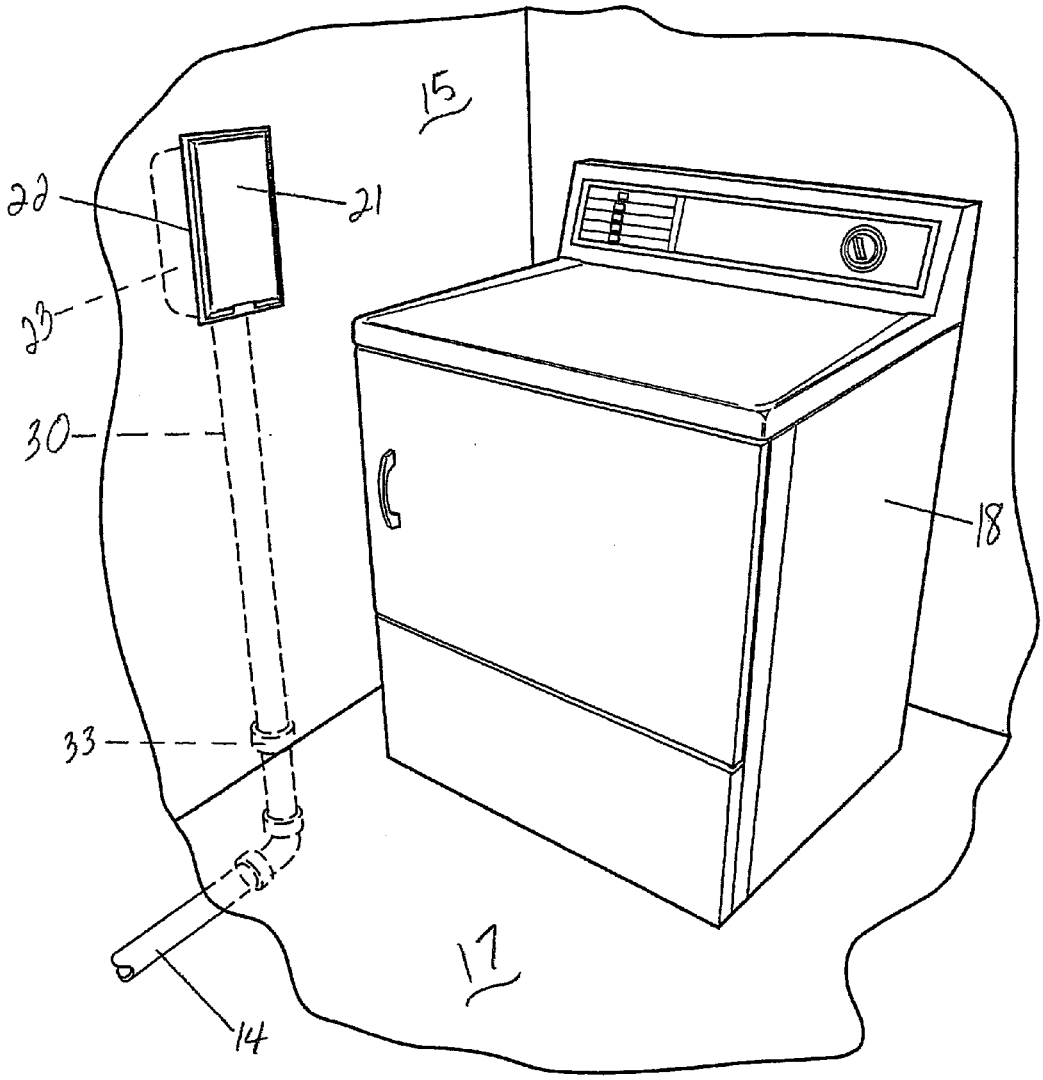
FIG. 1 shows an embodiment of the present invention installed in a room containing a laundry dryer as would be found in a residence and shows in dashed line, components that ordinarily would be hidden from the user's view.
Figure 5:
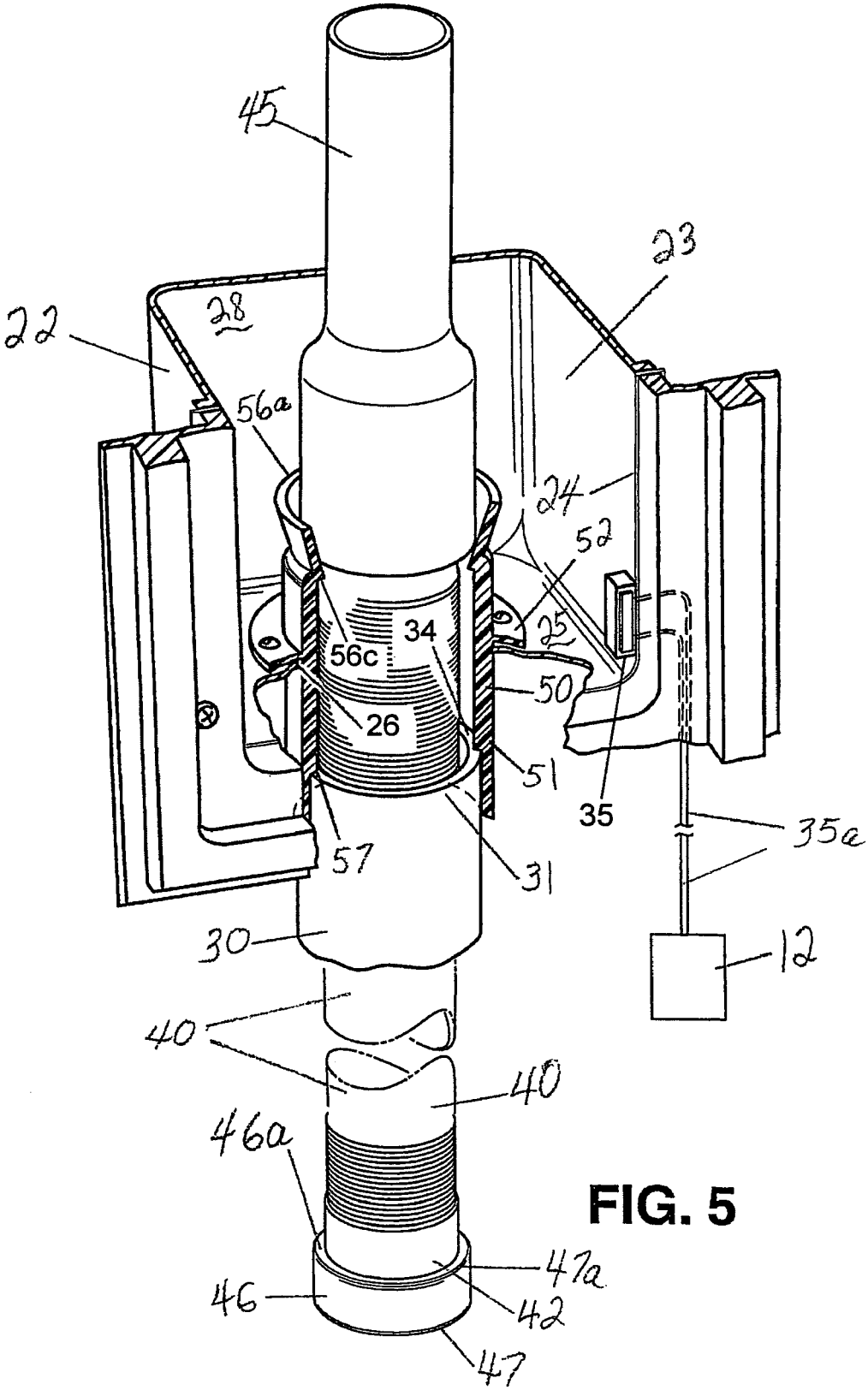
FIG. 5 is a partially cut away perspective view and partial cross-sectional view in detail of another embodiment of components of the present invention.

Presently preferred embodiments of components of the present invention are shown in FIGS. 1 and 5. FIG. 1 shows the embodiment in the state when the present invention is not in use, and in FIG. 2 when the present invention is in use.

Figure 2:
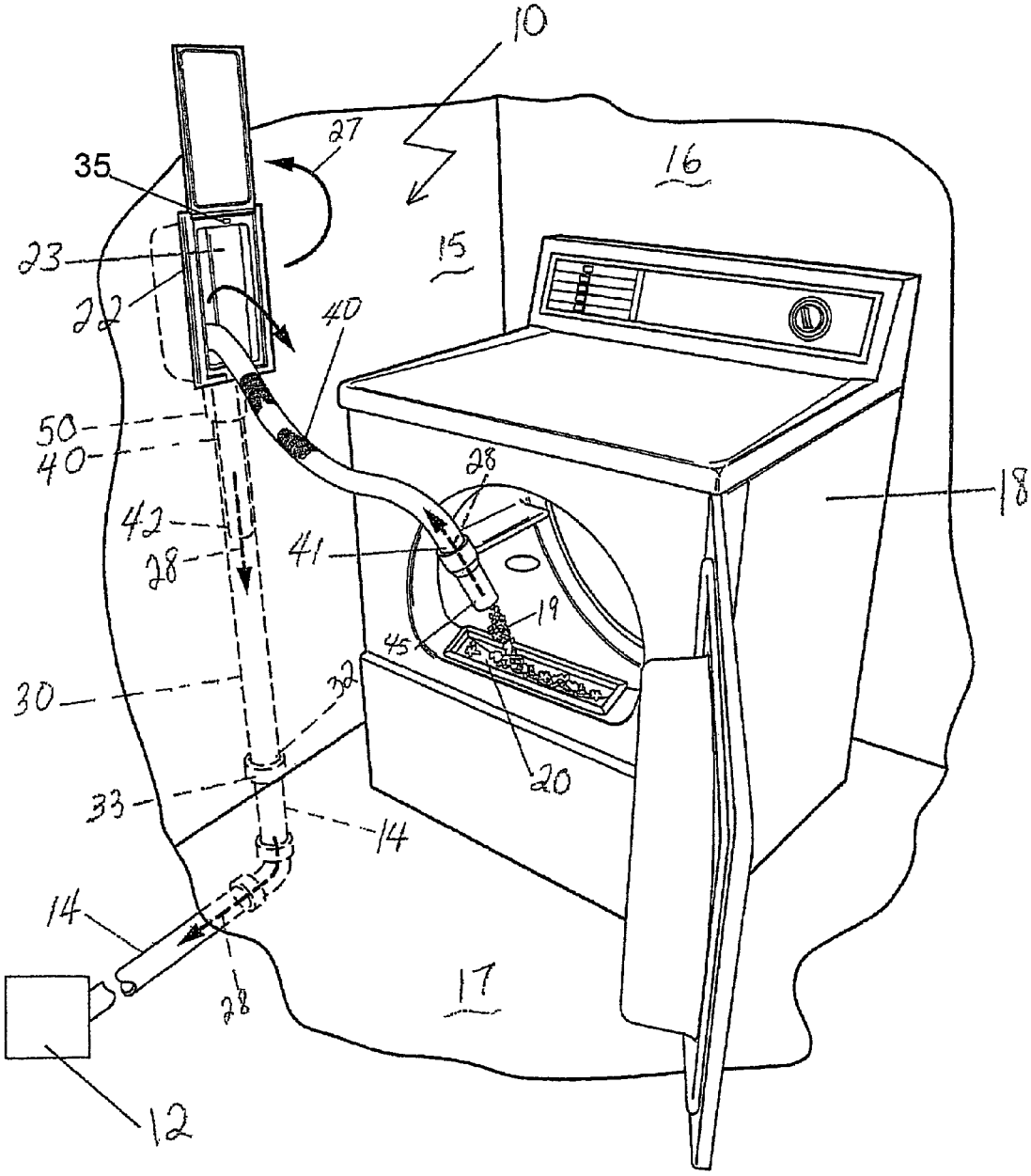
FIG. 2 shows an embodiment of the present invention installed in a room containing a laundry dryer as would be found in a residence and shows in dashed line, components that ordinarily would be hidden from the user's view.

As shown in FIG. 2 for example, an embodiment of the apparatus of the present invention is designated generally by the numeral 10. The apparatus 10 is configured to cooperate with a central vacuum system for removing debris generated in connection with a building that is fitted with the central vacuum system, which is designated schematically in FIG. 2 by the box that is designated by the numeral 12. As is conventional, ductwork 14 of the central vacuum system 12 is deployed throughout the building and is generally hidden behind at least one of the walls 15, 16 and/or flooring 17 and ceiling of selected rooms of the building.

In this exemplary embodiment shown in FIG. 2, the apparatus 10 is installed in the vicinity of a hot air dryer 18 in a laundry room, where it may be used for example in vacuuming the lint 19 that accumulates in the lint trap 20 of the dryer 18. However, dryer 18 in the residential setting has been chosen purely for purposes of ease of illustration of the present invention, which is not limited to this environment and thus can be used as an accessory in a variety of environments where a central vacuum system is installed. Such environments would include for example, industrial environments such as woodworking shops or metal working facilities where machinery accumulates debris that cannot be removed by automatic direction of suction orifices or other means and thus desirably is removed by manual direction of a vacuum nozzle.

Figure 3:
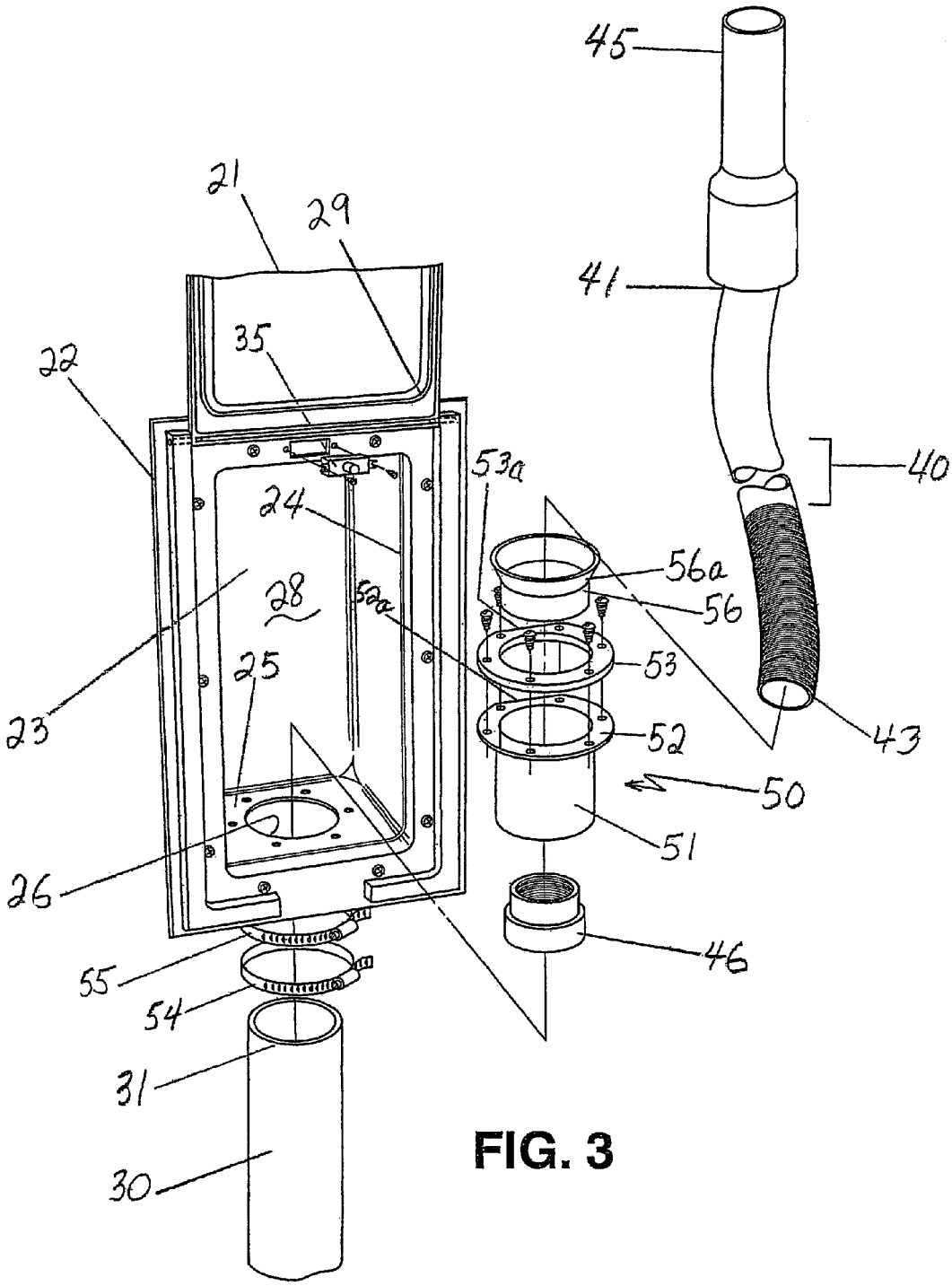
FIG. 3 is an exploded assembly view in detail of an embodiment of components of the present invention.

As embodied herein and shown in FIG. 2, the apparatus 10 of the present invention comprises a housing 22 that defines a compartment 23 internally of the housing 22. As shown in FIG. 3, the free edges of the walls that define the compartment 23 cooperate to define an access opening 24 into the interior space of the compartment 23.

As shown in FIGS. 2 and 3, a cover 21 is connected to the housing 22 and is configured to be moveable between a closed position that blocks user access to the access opening 24 of the housing 22 and seals the cover 21 to the housing 22 and an open position that permits user access to the access opening 24 of the housing 22 and thus into the interior space of the compartment 23. As shown in FIG. 3, a sealing member 29 can be defined on the surface of the cover 21 that opposes the housing 22 when the cover 21 is disposed in the closed position. Alternatively, the sealing member 29 can be defined on the surface of the housing 22 that opposes the cover 21 when the cover 21 is disposed in the closed position. The sealing member 29 can be an O-ring or similar flexible gasket that seals the cover 21 to the housing 22 in an airtight fashion so that when vacuum is provided by the central vacuum system when the cover 21 is closed, then air is not drawn into the housing 22 through the access opening 24. This prevents the vacuum pressure from being dissipated if the vacuum is being used in a different location than where the housing 22 is located. The cover 21 and connection mechanism are configured so that the user can lift the cover 21 with a single hand with little effort. In the embodiment shown, the cover 21 is hinged to the housing 22 so that it can be pivoted selectively by the user both away from (indicated by the arrow designated 27 in FIG. 2) and toward the housing 22.

As shown in FIG. 3, an activation switch 35 can be connected to control operation of the central vacuum system. The switch 35 can be carried by the housing 22. The switch 35 can be configured to activate the central vacuum system when the cover 21 is moved to the open position and to deactivate the central vacuum system when the cover 21 assumes the closed position.

As shown in FIG. 2, a hollow first length of storage conduit 30 has an open distal end 32 that is configured to be connected to a vacuum source of the vacuum system 12 via a connection fitting 33 attached to the pre-existing ductwork 14 of the vacuum system 12. Thus, the measured length of the storage conduit 30 typically will not need to be very long in order to reach the pre-existing ductwork 14. In the embodiment shown in FIGS. 1 and 2 for example, the first length of storage conduit 30 desirably measures from proximal end 31 to distal end 32 about three to four feet long. However, longer or shorter lengths can be used depending on the environment in which the device is to be used. Moreover, the storage conduit 30 desirably will be a straight length that does not have any bends between the compartment 23 and the ductwork 14 and desirably will be formed of rigid material such as polyvinylchloride pipe having at least one eighth inch wall thickness.

Figure 4:
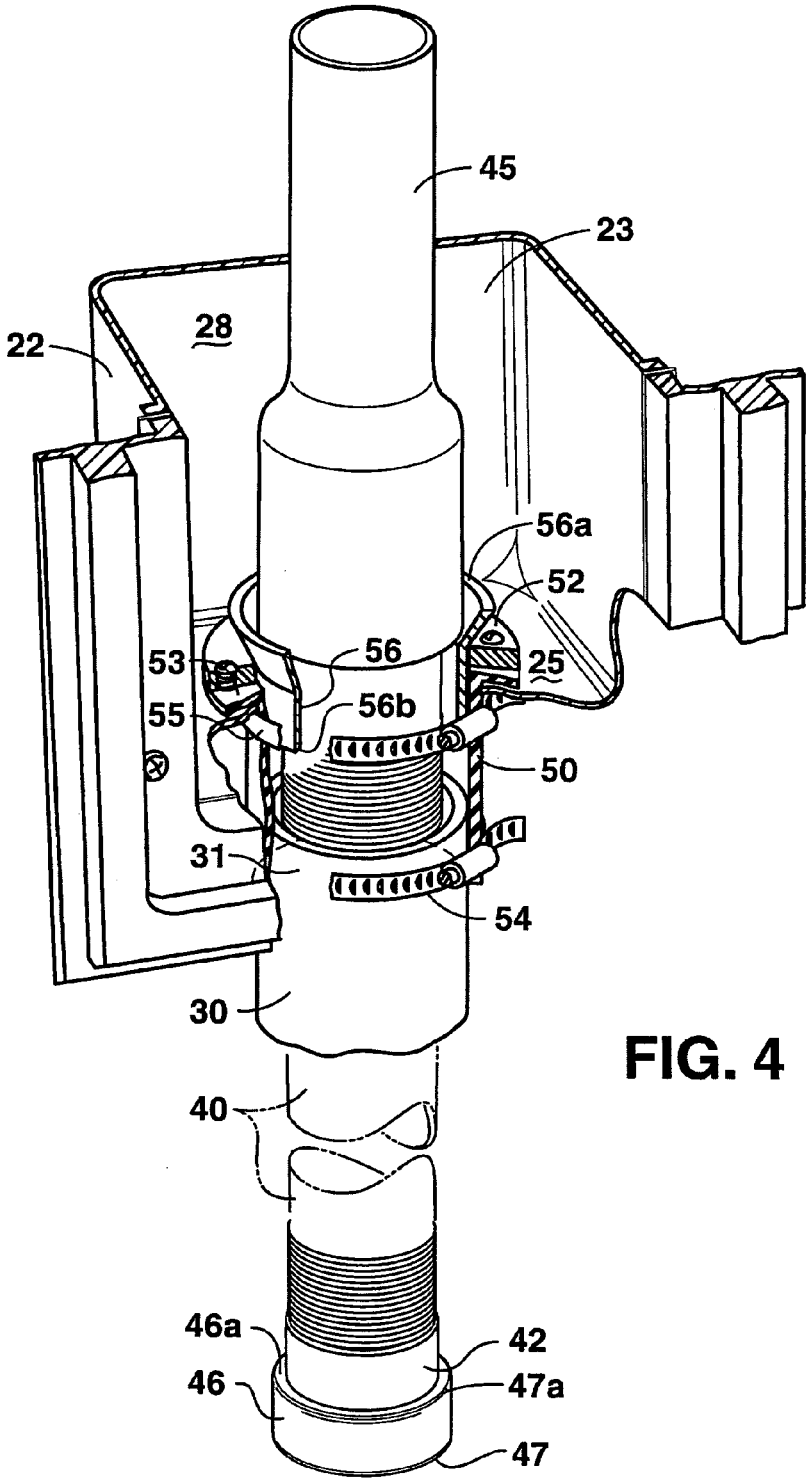
FIG. 4 is a partially cut away perspective view and partial cross-sectional view in detail of an embodiment of components of the present invention.

As shown in FIG. 2, a length of flexible, expandable hose 40 has a nozzle 45 attached to the proximal end 41 of hose 40 and a retaining fixture 46 attached to the distal end 42, which is disposed opposite the proximal end 41. The retaining fixture 46 is disposed within the storage conduit 30 and is configured to slide axially within the length of the storage conduit 30. As shown in FIGS. 4 and 5, the outer cylindrical edges 47, 47*a* of the distal end and proximal end, respectively, of the fixture 46 desirably are chamfered or beveled to provide radiused edges that reduce or eliminate galling of the interior surfaces of the walls of the storage conduit 30 as the retaining fixture 46 moves axially to and fro within the length of the storage conduit 30. The chamfered or beveled outer cylindrical edges 47, 47*a* of the retaining fixture 46 thereby facilitate easy sliding of the retaining fixture 46 against the interior surfaces of the walls within the storage conduit 30 and so maintain close enough clearance between the fixture 46 and the walls of the storage conduit 30 to sustain the necessary vacuum force while not impeding travel of the distal end 42 of the hose 40 within the storage conduit 30.

As shown in FIG. 3, one wall 25 of the compartment 23 defines a secondary opening 26. The open proximal end 31 of the hollow first length of storage conduit 30 is connected in fluid communication with the interior of the compartment through the secondary opening 26 of the housing 22. As shown in FIGS. 2 and 3, the storage conduit 30 is connected to the housing 22 via a connection sleeve 50.

In the embodiments shown in FIGS. 4 and 5, the connection sleeve 50 is configured with an elongated cylindrical portion 51 that is connected to an annular flange portion 52. The elongated cylindrical portion 51 and annular flange portion 52 of the connection sleeve 50 desirably form a unitary structure. To hold the connection sleeve 50 in place, a plurality of screws can be screwed through the holes in the flange portion 52 of the connection sleeve 50 and into the aligned holes in the wall 25 of the compartment 23.

As shown schematically in FIGS. 2 and 5, the cylindrical portion 51 of connection sleeve 50 fits through the secondary opening 26 in the housing 22 until the flange 52 rests against the wall 25 that partially defines compartment 23. Both the wall 25 and the flange 52 have a plurality of openings that align with one another. As shown in FIG. 3, a portion of the edge of the flange 52 is provided with a straight edge 52*a* that accommodates the rear wall 28 of the compartment 23 of the housing 22 when the connection sleeve 50 is fitted into the secondary opening 26. The cylindrical portion 51 of the connection sleeve 50 protrudes out of the secondary opening 26 of the compartment 23. The proximal end 31 of the storage conduit 30 is received within the cylindrical portion 51 of the connection sleeve 50, which desirably is formed of rubber or other like elastomeric material.

As shown in FIG. 5, the free edge 34 of the proximal end 31 of the storage conduit 30 can be configured to butt against a circumferentially extending interior ledge 57 that can be defined within the interior of the cylindrical portion 51 of the connection sleeve 50. The proximal end 31 of the storage conduit 30 can be held fixed by a friction fit within the distal portion of the cylindrical portion 51 of the connection sleeve 50. Alternatively, as shown in FIG. 4, an adjustable belt fastener 54 can be used to surround the exterior of the cylindrical portion 51 of the connection sleeve 50 and can be tightened so that the proximal end 31 of the storage conduit 30 is held fixed within the cylindrical portion 51 of the connection sleeve 50.

As shown in FIG. 4, a mounting gasket 53 can be provided with a plurality of holes that align with the holes in the flange portion 52 of the connection sleeve 50 and the wall 25 of the compartment 23. As shown in FIG. 3, a straight edge portion 53*a* desirably is provided to the gasket 53 to align with the straight edge portion 52*a* of the flange 52. To hold the connection sleeve 50 in place, a plurality of screws can be screwed through the holes in the gasket 53, in the flange portion 52 of the connection sleeve 50 and into the aligned holes in the wall 25 of the compartment 23.

As shown in FIGS. 4 and 5, a funnel member 56 is configured with a cylindrical body portion axially displaced from a conical flange 56*a*, which desirably is configured to receive and funnel the hose 40 into the storage conduit 30 when the hose 40 is being retracted within the storage conduit 30. As shown in FIG. 5, the cylindrical body portion 51, the conical flange 56*a* of the cylindrical funnel member 56 and the annular flange 52 of the connection sleeve 50 desirably can be formed as by plastic molding for example) as a unitary structure.

Alternatively, as shown in FIG. 4, the cylindrical body portion of the cylindrical funnel member 56 can be a separate piece from the connection sleeve 50. As shown in FIG. 4, the cylindrical body portion of the cylindrical funnel member 56 can be fitted within the aligned openings through the connection gasket 53 and the cylindrical body portion 51 of the connection sleeve 50. As shown in FIG. 4, another adjustable belt fastener 55 can be used to surround the exterior of the cylindrical portion 51 of the connection sleeve 50 that is disposed just beneath the underside of the wall 25 and can be tightened so that the cylindrical body portion of the funnel member 56 is held fixed within the cylindrical portion 51 of the connection sleeve 50.

As shown in FIGS. 4 and 5, the retaining fixture 46 desirably can be configured with a shoulder 46*a*. When the hose 40 is sufficiently extracted from within the storage conduit 30, the shoulder 46*a* of the retaining fixture 46 can engage the free edge 56*b* of the cylindrical portion of the funnel member 56 in the FIG. 4 embodiment. Thus, the free edge 56*b* of the cylindrical portion of the funnel member 56 can provide a ledge disposed in fluid communication with the storage conduit and configured to prevent passage of the retaining fixture out of the proximal end of the storage conduit 30. Similarly, the shoulder 46*a* of the retaining fixture 46 can engage the distal shoulder 56*c* of the conical flange 56*a* of the funnel member 56 in the FIG. 5 embodiment. Thus, the distal shoulder 56*c* of the conical flange 56*a* of the funnel member 56 can provide a ledge configured and disposed in the interior of the connection sleeve 50 and configured to prevent passage of the retaining fixture 46 out of the proximal end of the storage conduit 30. In each of these ways, the respective shoulder 46*a*, 56*c* prevents the distal end 42 of the hose 40, which is attached to and anchored inside the retaining fixture 46, from being separated from the storage conduit 30 by being completely withdrawn from within the storage conduit 30.

Referring to FIG. 1 for example, the apparatus of the present invention is shown installed in the vicinity of a laundry dryer 18 that might be found within the washroom of a residence. As schematically indicated by the dashed outline of the compartment 23, the housing 22 can be installed so that the compartment 23 can be disposed largely behind the wall 15 with only the cover 21 and the border of the housing 22 that surrounds the cover 21 being exposed in front of the outer surface of the wall 15. As schematically indicated by the dashed outline of the storage conduit 30, the storage conduit 30 likewise can be disposed behind the wall 15 and can be connected to the ductwork 14 of the central vacuum system 12 that is available for the room in question.

As shown in FIG. 2 and indicated schematically by the arrow designated 27, the operator lifts the cover 21, which can be done with one hand. The switch 35 can be configured to become actuated as the cover 21 pivots away from activation switch 35. As shown in FIG. 3, the cover 21 can be hinged at one end of the compartment 23, and the activation switch 35 can be disposed near the access opening 24 and at the same one end of the compartment 23 where the cover 21 is hinged. As shown in FIG. 5, the activation switch 35 can be disposed near the access opening 24 and at an end of the compartment 23 that is opposite the one end where the cover (not shown in FIG. 5) is hinged to the compartment 23.

Accordingly, the switch 35 can be spring-loaded as shown schematically in FIG. 2, or a proximity switch such as a magnetic switch 35 as shown schematically in FIG. 5 connected electrically via wires 35*a* to the central vacuum system 12. Other types of proximity switches such as one that sends a wireless signal to the central vacuum system 12 also can be used. Actuation of the switch 35 in turn activates the vacuum system 12, and accordingly the vacuum system 12 provides a vacuum through the ductwork 14. The direction in which the vacuum draws air into the hose 40 and storage conduit 30 as well as ductwork 14 is schematically indicated in FIG. 2 by the arrows that are designated by the numerals 28.

The user then can use the one and the same hand that opened the compartment to also grab the nozzle 45 and pull the hose 40 out of the storage conduit 30 and through the secondary opening 26 in the compartment 23 until the hose 40 is deployed with enough length (as by expanding beyond its storage length that it assumes when it is stored in the conduit 30) to reach the desired site where the suction of the vacuum is desired to be directed. In the case shown in FIG. 2, that site is the lint trap 20 of the dryer containing lint 19 that is to be vacuumed away.

In accordance with the present invention, the hose 40 is configured to be resiliently expandable and contractable between a fully contracted state and a fully expanded state. The hose 40 is shown in FIG. 3 in the fully contracted state and defines a plurality of resilient pleats or accordion-like folds 43 that are configured along the length of the hose 40. The pleats 43 are configured to be folded against one another so as to permit the length of the hose 40 to alternately expand and contract between the fully expanded state and the fully contracted state. The pleats 43 are relatively unfolded when the hose 40 assumes the fully expanded state and completely folded when the hose 40 is stored within the storage conduit 30. The hose 40 is resiliently biased to assume the fully retracted state in order to facilitate storage of the hose 40 within the least amount of length of the storage conduit 30. Accordingly, the length of the hose 40 in the fully contracted state need be no more than the first length of the storage conduit 30. Desirably, the length of the hose 40 in the fully expanded state is at least one and one half times the length of the hose 40 in the fully contracted state. Moreover, the length of the hose 40 in the fully expanded state can be at least two times greater than the length of the hose in the fully contracted state.

When the vacuuming is completed, the user moves the nozzle 45 back toward the housing 22 with the same one hand operation and allows the natural resilience of the expandable hose 40 to contract the length of the hose 40 and the suction of the central vacuum system 12 to suck the retaining fixture 46 at the distal end 42 of hose 40 as well as the body of the hose 40 into the storage conduit 30. However, the resiliently expandable hose 40 also will retract easily into the storage conduit 30 with the vacuum system 12 turned off.

The vacuum nozzle 45 fitted to the proximal end 41 (aka the nozzle end) of the hose 40 is configured to prevent passage of the nozzle 45 completely through the secondary opening 26 of the housing 22. As shown in FIG. 4, the diameter of the cylindrical portion 56*b* of the funnel member 56 can be sized smaller than the diameter of the base of the nozzle 45 and thus prevent the nozzle 45 from passing into the storage conduit 30. Alternatively, as shown in FIG. 5, the distal shoulder 56*c* of the conical flange 56*a* of the funnel member 56 can jut toward the centerline of the connection sleeve 50 and thereby constrict the diameter of the connection sleeve 50 sufficiently to prevent the nozzle 45 from passing into the storage conduit 30.

Once the user seats the nozzle 45 in the funnel member 56 within the compartment 23, the user then can close the cover 21 with one hand to seal off the access opening 24. In the embodiment shown, this closing movement of the cover 21 also will engage the switch 35 in a manner such that the central vacuum system 12 will cease operation. Thus, the entire operation of the apparatus of the present invention, from opening of the cover 21 to closing of the cover 21, can be accomplished with the same one hand of the user.

While at least one presently preferred embodiment of the invention has been described using specific terms, such description is for illustrative purposes only, and it is to be understood that changes and variations may be made without departing from the spirit or scope of the following claims.

What is claimed is:

1. An apparatus configured to be connected to the ductwork of a central vacuum system for removing debris in the immediate vicinity of the apparatus, comprising:

a housing defining a compartment, said compartment defining an interior space and an access opening to said interior space, said compartment defining a secondary opening;

a hollow first length of storage conduit having one open end connected to said secondary opening of said housing and having a distal open end configured to be connected to the ductwork of the central vacuum system;

a length of flexible hose having a nozzle end and a distal end disposed opposite said nozzle end, said distal end including a retaining fixture disposed within said storage conduit and configured to slide within said storage conduit, said hose being configured to be resiliently expandable and contractable between a fully contracted state and a fully expanded state, the length of said hose in the fully contracted state being no more than the length of said first length of said storage conduit, said hose being configured to remain in the fully contracted state in the absence of force being applied to stretch the length of said hose, the length of said hose in the fully expanded state being greater than the length of said hose in the fully contracted state;

a vacuum nozzle fitted to said nozzle end of said hose, said vacuum nozzle being configured to prevent passage of said nozzle completely through said secondary opening of said housing;

a cover connected to said housing and configured to be moveable between a closed position that blocks user access to said access opening of said housing and seals said cover to said housing and an open position that permits user access to said access opening of said housing; and an activation switch configured to be connected to control operation of the central vacuum system, said switch being carried by said housing and configured to activate the central vacuum system when said cover is moved to said open position and to deactivate the central vacuum system when the cover assumes said closed position.

2. An apparatus as in claim 1, further comprising a retaining fixture attached to the distal end of said hose, said retaining fixture being disposed within the storage conduit configured to slide axially within the length of the storage conduit.

3. An apparatus as in claim 2, wherein the retaining fixture defines a proximal end and a distal end, wherein a proximal outer cylindrical edge is defined at the proximal end of the retaining fixture, wherein a distal outer cylindrical edge end is defined at the distal end of the fixture, and wherein each of the proximal outer cylindrical edge and the distal outer cylindrical edge is chamfered or beveled to reduce the incidence of galling of the interior surfaces of the walls of the storage conduit when the retaining fixture travels axially within the storage conduit.

4. An apparatus as in claim 2, wherein retaining fixture defines a proximal end and a distal end, wherein a proximal outer cylindrical edge is defined at the proximal end of the retaining fixture, wherein a distal outer cylindrical edge end is defined at the distal end of the fixture, and wherein the outer cylindrical edges of the retaining fixture are configured to facilitate easy sliding of the retaining fixture axially against the interior surfaces of the walls of the storage conduit and so maintain close enough clearance between the retaining fixture and the walls of the storage conduit to sustain the necessary vacuum force while not impeding travel of the distal end of the hose within the storage conduit.

5. An apparatus as in claim 1, further comprising a connection sleeve disposed to extend through said secondary opening and attached to said compartment wall and connected to said storage conduit.

6. An apparatus as in claim 5, further comprising a ledge configured and disposed in the interior of said connection sleeve and configured to prevent passage of said retaining fixture.

7. An apparatus as in claim 5, wherein said connection sleeve comprises a cylindrical portion, a funnel member and an annular flange portion disposed between and connected to each of said cylindrical portion and funnel member.

8. An apparatus as in claim 7, wherein said connection sleeve is connected to said compartment via said annular flange portion.

9. An apparatus as in claim 7, wherein said connection sleeve comprising said cylindrical portion, funnel member and annular flange portion is formed as a unitary structure.

10. An apparatus as in claim 1, further comprising a ledge disposed in fluid communication with said storage conduit and configured to prevent passage of said retaining fixture.

11. An apparatus as in claim 1, wherein said activation switch is a magnetic proximity switch.

12. An apparatus as in claim 1, wherein said activation switch is configured to send a wireless signal to the vacuum system.

13. An apparatus as in claim 1, wherein said cover is hinged at one end to said compartment and said activation switch is disposed near said access opening and at an end of said compartment opposite said one end.

14. An apparatus as in claim 1, wherein the first length of the storage conduit is less than four feet.

15. An apparatus as in claim 1, wherein the length of said hose in the fully expanded state being at least one and one half times greater than the length of said hose in the fully contracted state.

16. An apparatus as in claim 1, wherein the storage conduit is axially straight and does not have any bends as it extends between the compartment and the ductwork of the central vacuum system.

17. An apparatus as in claim 1, wherein said hose defines a plurality of resilient pleats configured along the length thereof and configured so as to permit the length of said hose to alternately expand and contract between said fully expanded state and said fully contracted state, the length of said hose in said fully expanded state being at least twice the length of said hose in said fully contracted state, and said pleats being relatively unfolded when said hose assumes said fully expanded state.

18. An apparatus configured to be connected to the ductwork of a central vacuum system for removing debris in the immediate vicinity of the apparatus, comprising:

a housing defining a compartment, said compartment defining an interior space and an access opening to said interior space, said compartment defining a secondary opening;

a hollow first length of storage conduit having one open end connected to said secondary opening of said housing and having a distal open end configured to be connected to the ductwork of the central vacuum system;

a length of flexible hose having a nozzle end and a distal end disposed opposite said nozzle end, said distal end including a retaining fixture disposed within said storage conduit and configured to slide within said storage conduit, said hose being configured to be resiliently expandable and contractable between a fully contracted state and a fully expanded state, the length of said hose in the fully contracted state being no more than the length of said first length of said storage conduit, wherein the length of said hose in the fully expanded state being at least one and one half times greater than the length of said hose in the fully contracted state;

a vacuum nozzle fitted to said nozzle end of said hose, said vacuum nozzle being configured to prevent passage of said nozzle completely through said secondary opening of said housing;

a cover connected to said housing and configured to be moveable between a closed position that blocks user access to said access opening of said housing and an open position that permits user access to said access opening of said housing;

an activation switch configured to be connected to control operation of the central vacuum system, said switch being carried by said housing and configured to activate the central vacuum system when said cover is moved to said open position and to deactivate the central vacuum system when the cover assumes said closed position;

a retaining fixture attached to the distal end of said hose, said retaining fixture being disposed within the storage conduit configured to slide axially within the length of the storage conduit, wherein the retaining fixture defines a proximal end and a distal end, wherein a proximal outer cylindrical edge is defined at the proximal end of the retaining fixture, wherein a distal outer cylindrical edge end is defined at the distal end of the fixture, and wherein the outer cylindrical edges of the retaining fixture are configured to facilitate easy sliding of the retaining fixture axially against the interior surfaces of the walls of the storage conduit and so maintain close enough clearance between the retaining fixture and the walls of the storage conduit to sustain the necessary vacuum force while not impeding travel of the distal end of the hose within the storage conduit; and a connection sleeve disposed to extend through said secondary opening and comprising a cylindrical portion, a funnel member and an annular flange portion disposed between and connected to each of said cylindrical portion and funnel member, said connection sleeve being connected to said compartment via said annular flange portion.

* * * * *